US009994292B2

(12) United States Patent
Bowman et al.

(10) Patent No.: US 9,994,292 B2
(45) Date of Patent: Jun. 12, 2018

(54) EMERGENCY UNDERWATER MINIATURIZED BREATHING DEVICE

(71) Applicants: Clayton Gregory Bowman, Ladera Ranch, CA (US); Tyler Jamison Bowman, Capistrano Beach, CA (US)

(72) Inventors: Clayton Gregory Bowman, Ladera Ranch, CA (US); Tyler Jamison Bowman, Capistrano Beach, CA (US); Joseph-Eamonn Clerkin, Belmont, CA (US); Janusz Labedz, Mountain View, CA (US); Randy Cardona, Aptos, CA (US)

(73) Assignees: Clayton Gregory Bowman, Ladera Ranch, CA (US); Tyler Jamison Bowman, Capistrano Beach, CA (US)

( * ) Notice: Subject to any disclaimer, the term of this patent is extended or adjusted under 35 U.S.C. 154(b) by 356 days.

(21) Appl. No.: 14/692,743

(22) Filed: Apr. 22, 2015

(65) Prior Publication Data

US 2016/0310768 A1 Oct. 27, 2016

(51) Int. Cl.
*B63C 11/18* (2006.01)
*A62B 7/02* (2006.01)
(Continued)

(52) U.S. Cl.
CPC ..... *B63C 11/22* (2013.01); *A62B 7/02* (2013.01); *B63B 35/7933* (2013.01);
(Continued)

(58) Field of Classification Search
CPC ..... B63C 11/18; B63C 11/22; B63C 11/186; B63C 11/00; B63B 35/7933; A62B 9/02;
(Continued)

(56) References Cited

U.S. PATENT DOCUMENTS 3,045,671 A * 7/1962 Updegraff ..... A62B 7/00 128/205.21
3,425,414 A * 2/1969 Roche ..... A61M 11/02 128/203.21
(Continued)

FOREIGN PATENT DOCUMENTS

WO WO 2014143173 A1 * 9/2014 ..... A61M 15/0086

OTHER PUBLICATIONS

Lindh et al, Delmar's Comprehensive Medical Assisting Administrative and Clinical Competencies, 2009, 4th Edition, p. 573.*

*Primary Examiner* — Timothy Stanis
(74) *Attorney, Agent, or Firm* — Dorian Cartwright

(57) ABSTRACT

A miniature breathing device for underwater breathing that can be worn on a person during water activities. A small form factor and lightweight housing suitable for submerging in shallow water. The small form factor preventing disruption of activities of a user undertaken while wearing the miniature breathing device. A canister within the housing stores a mixture of compressed air. An actuator on the housing to controllably releases the compressed air from the canister. A regulator piston within the housing is shaped with chambers to decompress the compressed air to breathable form. A mouthpiece opening of the housing provides breathable air to lips of a user. A strap secures the miniature breathing device to the user during activities.

9 Claims, 3 Drawing Sheets

200

(51) Int. Cl.
*B63C 11/22* (2006.01)
*B63B 35/79* (2006.01)
*A62B 9/02* (2006.01)

(52) U.S. Cl.
CPC ..... *B63C 11/18* (2013.01); *B63C 11/186* (2013.01); *A62B 9/02* (2013.01)

(58) Field of Classification Search
CPC .... A62B 9/06; A62B 7/00; A62B 7/02; A62B 7/04; A62B 7/06; A62B 7/08; A62B 7/10; A62B 7/12; A62B 7/14; A61M 11/00; A61M 2202/0208
See application file for complete search history.

(56) References Cited

U.S. PATENT DOCUMENTS

| | | | | |
|---|---|---|---|---|
| 4,996,982 | A * | 3/1991 | Williamson | A62B 7/04 128/205.24 |
| 5,660,172 | A * | 8/1997 | Hatton | A62B 7/02 128/201.28 |
| 7,182,108 | B2 * | 2/2007 | Williamson | B63C 11/22 141/20 |
| 7,204,247 | B1 * | 4/2007 | Rogerson | A61M 15/009 128/200.23 |
| 8,166,973 | B2 * | 5/2012 | Pan | A62B 7/02 128/205.24 |
| 2001/0020470 | A1 * | 9/2001 | Zupan | A61M 15/0065 128/200.24 |

* cited by examiner

SECTION A-A
SCALE 2:1

EMERGENCY UNDERWATER MINIATURIZED BREATHING DEVICE

FIELD OF THE INVENTION

The invention relates generally to an emergency underwater breathing device, and more specifically, to a small form factor underwater breathing device that can be worn on a person during water activities.

BACKGROUND

Water activities such a surfing, open water swimming, water skiing, scuba diving, snorkeling and the like, each put people in danger of drowning. Large waved and undercurrents can unexpectedly create an emergency scenario in which immediate and reliable access to air is necessary. Scuba divers supplied with large, heavy compressed air tanks can also be put in emergency situations due to defects and depletion, for example.

A timeless difficulty with safety equipment in water activities is that the size and weight of such equipment limits a person from enjoyment of the activity. For example, conventional compressed air tanks used by scuba divers are so large and heavy, and are not tightly attached to the body to be amenable for a surfer. Similarly, life jackets, although relatively lightweight, are very bulky in order to provide buoyancy.

In particular, the large size of conventional air tanks led to the design of a 90 degree mouthpiece so that the air tanks can be vertically oriented. As such, the air tanks fit comfortably against a torso out of the way during dives. The 90 degree design can require additional space-consuming components.

It would be desirable to address these and other shortcomings of water safety.

SUMMARY

The above shortcomings are addressed by a miniature breathing device for underwater breathing that can be worn on a person during water activities, and method for operating the same.

In one embodiment a small form factor and lightweight housing suitable is utilized for submerging in water (e.g., shallow water). The small form factor prevents disruption of activities of a user undertaken while wearing the miniature breathing device. A canister within the housing stores a mixture of breathable fluid.

In an embodiment, an actuator on the housing is implemented to controllably release the compressed air from the canister. A regulator piston within the housing is shaped with chambers to decompress the compressed air to breathable form. A mouthpiece opening of the housing provides breathable air to lips of a user. A strap secures the miniature breathing device to the user during activities, and breaks away quickly when needed during an emergency.

In another embodiment, an inline design avoids the typical 90 degree mouthpiece design. In more detail, a mouthpiece is inline with a user's mouth so that the miniature breathing device is generally horizontal during use.

Advantageously, water activities can be enjoyed in comfort of safety during an emergency situation. A miniature breathing device is small enough to stay out of the way, while being attached in a secure manner.

BRIEF DESCRIPTION OF THE DRAWINGS

In the following drawings, like reference numbers are used to refer to like elements. The Figures depict various embodiments for purposes of illustration only. One skilled in the art will readily recognize from the following discussion that other embodiments of the structures and methods illustrated herein may be employed without departing from the described principles.

DETAILED DESCRIPTION

The present disclosure provides a miniature breathing device for use in underwater breathing, and methods for operating the same.

Figure 1A:
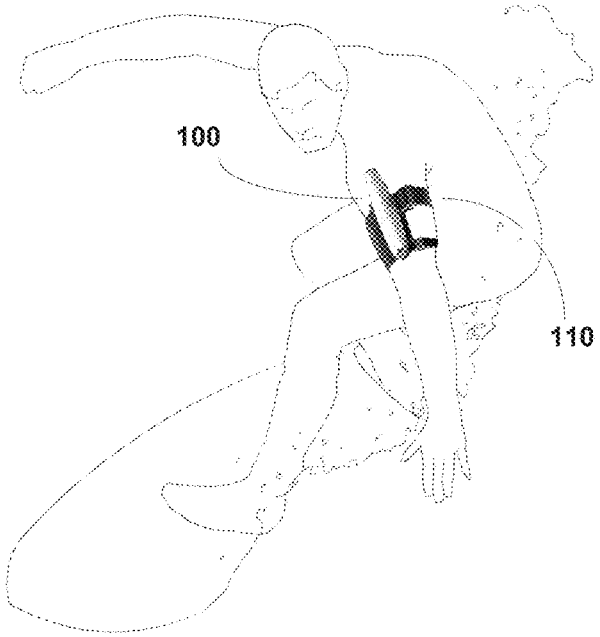
FIG. 1A is a perspective diagram illustrating a miniature breathing device worn by a user during water activities, according to one embodiment of the present invention.

FIG. 1A is a perspective diagram illustrating a miniature breathing device 100 worn by a user during water activities, according to one embodiment of the present invention. A form factor of the miniature breathing device 100 is small enough such that there is minimal disruption to water activities, yet the miniature breathing device 100 is rugged enough to remain intact. In this particular example, a surfer rides waves in the open ocean. The miniature breathing device 100 is supported by straps 110 around the surfer's arm. The straps can have VELCRO®, snaps, clip, magnet, strap, buttons or any other mechanism to secure the miniature breathing device 100, but also easily breakaway during an emergency. As a result, the surfer can swim, surf, and wipe out, while the miniature breathing device 100 remains within grasp at any time. In other examples, a user can be water skiing, swimming in open ocean, snorkeling, scuba diving, swimming laps in a swimming pool, or even hiking in a cave that may have dangerous gases. The miniature breathing device 100 can also be carried by safety and rescue, military, coast guard, and the like. There are countless other activities that could require the use of oxygen in an emergency.

Figure 1B:
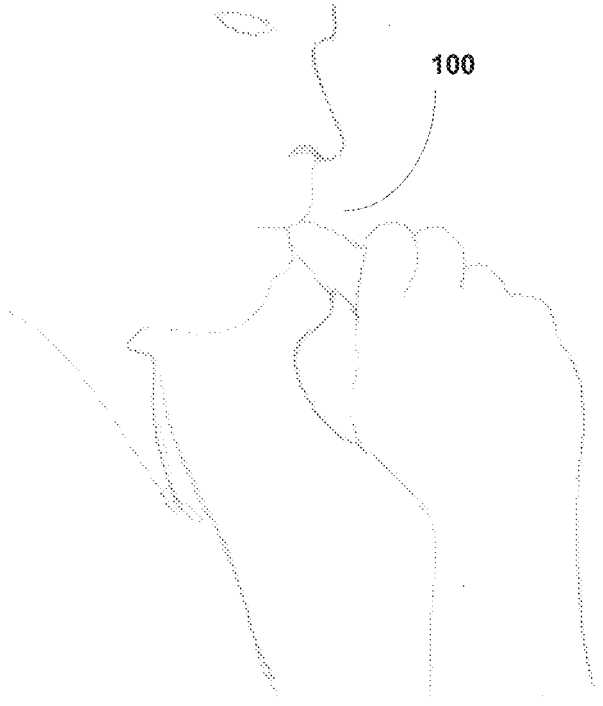
FIG. 1B is a perspective diagram illustrating the miniature breathing device being used for breathing, according to some embodiments of the present invention.

FIG. 1B is a perspective diagram illustrating the miniature breathing device 100 being used for inline breathing, according to some embodiments of the present invention. For example, the surfer can wipe out and become disoriented underwater, as a possible drowning scenario. Similarly, the swimmer may run into turbulent waters. In these cases, the miniature breathing device 100 is designed to be immediately assessable, so the straps 110 can breakaway when pulled with enough force. With a single hand, a user can depress a button to actuate the release of compressed air stored within the miniature breathing device 100. In one embodiment, actuation is responsive to biting pressure or vacuum pressure from sucking. In another embodiment, a dual trigger prevents accidental air release. Depending on the size of storage and the user, the breathing device can provide, for example, 1 to 5 breaths of air supply. In an embodiment, the miniature breathing device 100 operates from an inline orientation in which an air path flows horizontally to a user's mouth.

Figure 2:
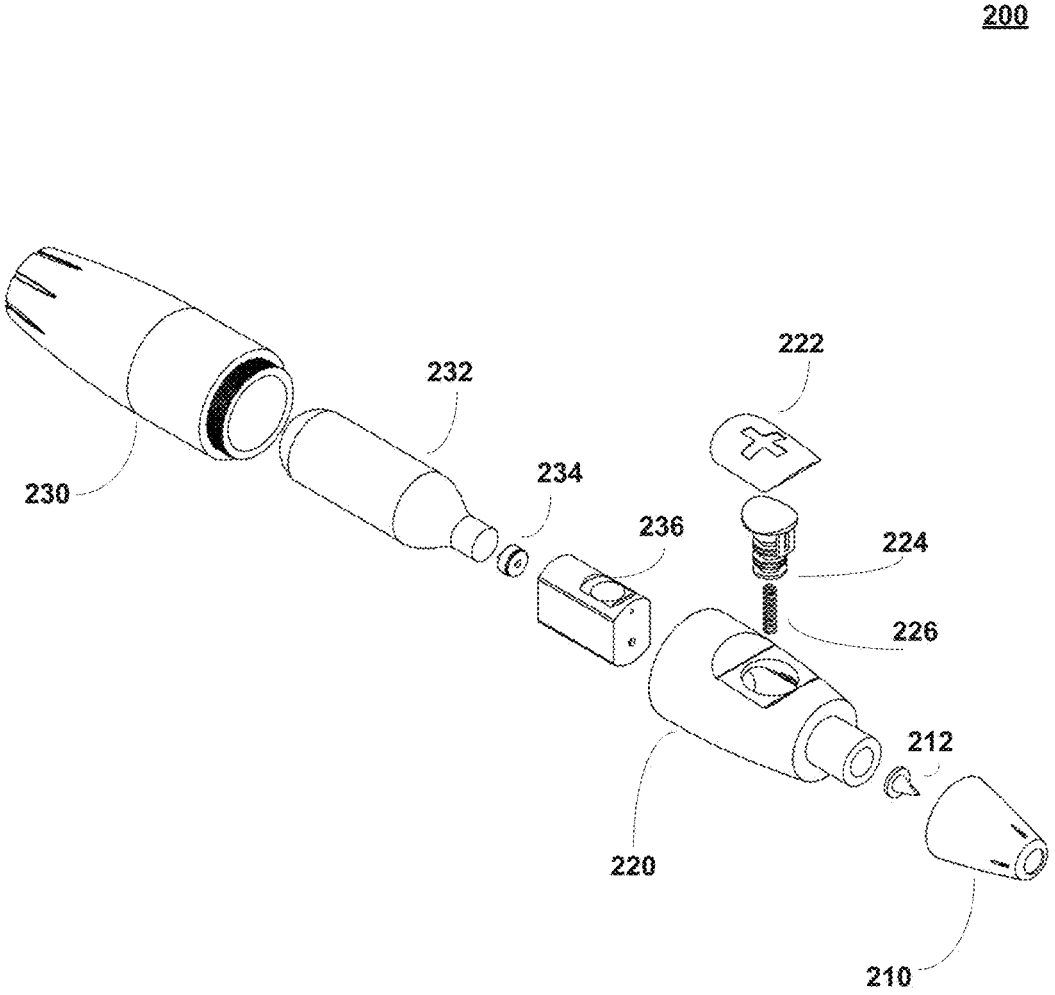
FIG. 2 is a perspective diagram illustrating an exploded view of the miniature breathing device, according to one embodiment.

FIG. 2 is a perspective diagram illustrating an exploded view of the miniature breathing device 100, according to one embodiment. The miniature breathing device 100 comprises three exterior components, a mouthpiece 210, an upper body 220, and a lower body 230. Generally, the lower body 230 stores the air mixture, which is released in a calculated manner using the upper body 220, and passed to user lips through the mouthpiece 210. The upper and lower bodies 220, 230 can be attached with a threaded interface on an exterior surface of the lower body 230 mates with a threaded interface on an interior surface of the upper body 220 on one end. On another end of the upper body 220, the mouthpiece 210 can be pressure fitted to connect. In other embodiments, the components can be snapped together, glued, welded, screwed, or attached in any appropriate manner. The components can be generally composed of plastic, rubber, metal (e.g., aluminum or stainless steel), neoprene, rubberized silicone, and any combination thereof. The materials allow the miniature breathing device 100 to be lightweight, rugged, and waterproof.

Each of the exterior components house several interior components exposed by the exploded view. A canister 232 fits within the lower body 230. The canister 232 can be, for example, 3 or 4 inches long and have 14 ml at 1 Atm and store 12 grams of CO2. The contents can be compressed air, O2, or similar breathable fluid. Supposing a male inspiratory capacity is about 3.5 L and a female is about 2.4 L, 1 to 2 breaths of usable lung volume is provided by the canister 232. An implementation-specific mixture of compressed air and is sealed by a membrane. A piercing valve 234 has a needle on one end facing the canister 232 to pierce the sealing membrane in order to release gas. A valve body 236 directs a path of released gas. Along with a regulator piston 224, the pressure is reduced to a useable level.

The upper body 220 actuates the miniature breathing device 100 when the actuator button 222 is depressed by a user. The regulator piston 224 creates a flow path for air between the canister 232 and the mouthpiece 210, and also controls release of the air mixture. A return spring 226 controls the air path by opening the piston when depressed and closes the piston when released. In an embodiment, the actuator button 222 releases more compressed air when pressed harder and/or for a longer duration.

The mouthpiece 210 covers a one-way valve 212 that fits within the upper body 220. The fitting allows air to be released to the mouthpiece 210 in one direction. At the same time, the one-way valve 212 prevents ingress of water into the air pathway, essentially water-proofing the miniature breathing device 100.

Figure 3A:
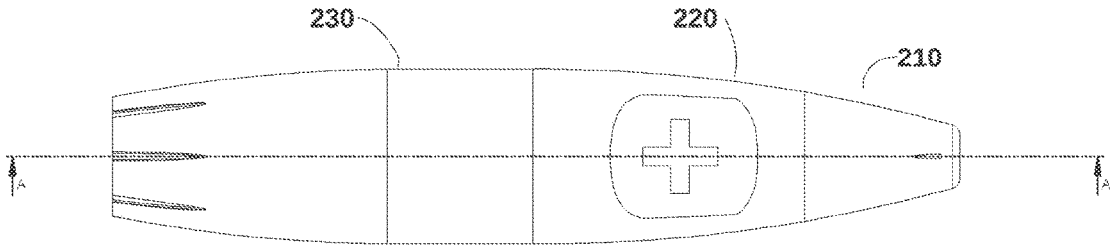
FIGS. 3A 3B are perspective diagrams illustrating cross-section views of the miniature breathing device, according to some embodiments.
Figure 3B:
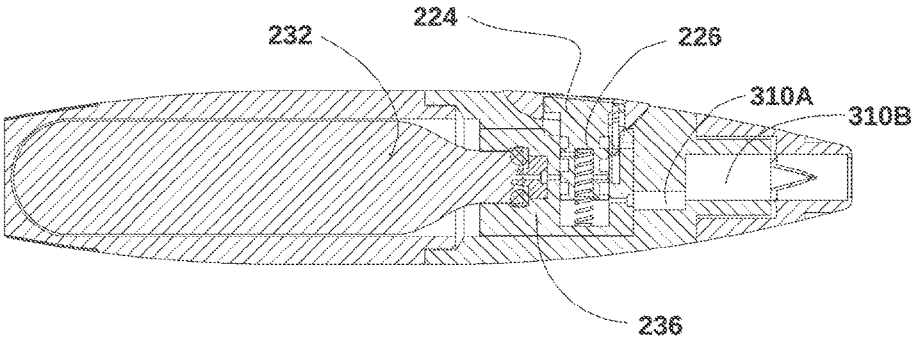

FIGS. 3A-3B are perspective diagrams illustrating cross-section views of the miniature breathing device 100, according to some embodiments. Example sizes of the miniature breathing device 100 are 8 to 12 inches in length and 1 to 2 inches in diameter.

From the current view, the canister 232 is shown to protrude into the regulator piston 224. Further, the piercing valve creates an opening of the air mixture to escape the canister 232. However, the return spring 226 blocks the opening prior to being actuated. It is when the return spring 226 is compressed, that the opening is unblocked and the air mixture can travel through the regulator piston 224. Chambers 310A,B within the regulator piston 224 are positioned and sized to allow the air mixture to expand to a usable pressure. More specifically, in one embodiment, chamber 310A is larger than an inlet opened by a depressed return spring 226, and chamber 310B is larger than an inlet from the chamber 310B. A slight offset between the chambers 310A and 310B provides further pressure regulation.

In some embodiments, the canister 232 can be removed and replaced or refilled by unscrewing the exterior components. In other embodiments, the canister 232 is refilled without any or with minimal disassembly.

In other alternatives, aggressive chamfers (e.g., grooves) made of rubber provide better gripping, especially in wet environments. Other designs are worn like a glove for even more security.

In one embodiment, an inline design allows the miniature size relative to conventional breathing tanks. In more detail, conventional devices using a 90 degree mouthpiece allow the tank to conveniently orient from vertically but can require additional space-consuming components to operate. The miniature breathing device 100 being small in size and temporary in use, is able to conserve space with the inline design in which the canister 232, the chambers 310A,B, and mouthpiece 210 are oriented generally in a parallel manner.

In yet another embodiment, the miniature breathing device 100 is preferably used in shallow water situations (e.g., 5 or 10 feet deep) that are not subject to the more intense pressure of deep waters. As a result, components can be lightweight.

As will be understood by those familiar with the art, the subject matter described herein may be embodied in other specific forms without departing from the spirit or essential characteristics thereof. Likewise, the particular naming and division of the portions, modules, agents, managers, components, functions, procedures, actions, layers, features, attributes, methodologies, data structures and other aspects are not mandatory or significant, and the mechanisms that implement the subject matter or its features may have different names, divisions and/or formats. The foregoing description, for purpose of explanation, has been described with reference to specific embodiments. However, the illustrative discussions above are not intended to be exhaustive or limiting to the precise forms disclosed. Many modifications and variations are possible in view of the above teachings. The embodiments were chosen and described in order to best explain relevant principles and their practical applications, to thereby enable others skilled in the art to best utilize various embodiments with or without various modifications as may be suited to the particular use contemplated.

We claim:

1. A miniature breathing device to provide air for underwater breathing, comprising:

a miniature inline form factor housing suitable for submerging in water, the miniature inline form factor housing preventing disruption of activities of a user undertaken while wearing the miniature breathing device;

a canister within the miniature inline form factor housing to store a mixture of compressed air;

an actuator comprising a button on the miniature inline form factor housing that is configured to be depressed to controllably release the mixture of compressed air from the canister;

a regulator piston within the miniature inline form factor housing;

a first and second chamber oriented in a miniature inline design, the first chamber of a first cross-section size and the second chamber of a second cross-section size that is larger than the first cross-section size, the second chamber positioned contiguous in parallel orientation to the first chamber and offset from the first chamber to regulate pressure, wherein an air path starting from the canister comprises the mixture of the compressed air at a first pressure, at the first chamber comprises the mixture of compressed air at a second pressure, and at the second chamber comprises the mixture of compressed air at a third pressure in breathable form at an end of the air path;

a mouthpiece opening of the miniature inline form factor housing configured to provide breathable air to lips of the user, wherein the canister, first chamber, second chamber and the mouthpiece opening are oriented in a common parallel inline orientation in the miniature inline design; and a strap configured to secure the miniature breathing device to the user during activities.

2. The miniature breathing device of claim 1, wherein the canister is configured to be refilled with the mixture of compressed air.

3. The miniature breathing device of claim 1, wherein the strap is configured to be attached to an arm of the user during activities.

4. The miniature breathing device of claim 1, wherein the miniature inline form factor housing comprises rubber chamfers configured to provide a grip for the user in wet environments.

5. The miniature breathing device of claim 1, wherein the actuator is configured to be depressed to compress a return spring which permits the mixture of compressed air to enter the regulator piston.

6. The miniature breathing device of claim 1, wherein the first chamber of the first cross-section size is upstream the second chamber of the second cross-section size, the second chamber being upstream from the mouthpiece opening.

7. The miniature breathing device of claim 1, configured in an inline design such that the canister, the chambers, and the mouthpiece opening, are oriented in a parallel air flow.

8. The miniature breathing device of claim 1, wherein a capacity of the canister provides approximately one to five breaths of the breathable air.

9. The miniature breathing device of claim 1, wherein the strap comprises a breakaway strap.

* * * * *